United States Patent [19]

Garritano

[11] Patent Number: 4,744,280

[45] Date of Patent: May 17, 1988

[54] ELECTRONIC HARP

[76] Inventor: Ralph F. Garritano, P.O. Box 106, Patchogue, N.Y. 11772

[21] Appl. No.: 919,671

[22] Filed: Oct. 16, 1986

[51] Int. Cl.[4] ..... G10D 1/04; G10H 3/18

[52] U.S. Cl. ..... 84/1.16; 84/264

[58] Field of Search ..... 84/1.14–1.16, 84/264–266, DIG. 24

[56] References Cited

U.S. PATENT DOCUMENTS

| | | | |
|---|---|---|---|
| 549,804 | 11/1895 | Lyon | 84/264 |
| 707,041 | 8/1902 | Weigel | 84/264 |
| 722,602 | 3/1903 | Moerscher | 84/264 |
| 1,896,683 | 2/1933 | Clark | 84/1.16 |
| 2,137,160 | 11/1938 | Franklin | 84/264 |

*Primary Examiner*—Stanley J. Witkowski

*Attorney, Agent, or Firm*—Handal & Morofsky

[57] ABSTRACT

An electronic harp (10) of the type including a plurality of strings (22) corresponding to the diatonic scale is disclosed. Chromatic operation is achieved by selective frequency shifting of individual string frequencies in response to selection by an operator. The harp (10) includes a foot (26) and a handle (24) and is designed to provide for a minimum of mechanical vibration. A channel VSO (48) driven by strings (22) provides an audio output signal.

8 Claims, 2 Drawing Sheets

ELECTRONIC HARP

TECHNICAL FIELD

The present invention relates to electronic musical instruments. In particular, the invention is concerned with a chromatic harp which achieves true chromatic operation while preserving traditional stringed response, without the need for conventional string pitch varying arrangements.

BACKGROUND ART

Since very early times, harps have seen widespread employment in a great diversity of different types of music. During the Renaissance, composers made extensive use of the harp because of its unique ability to respond to subtle variations in the manner in which it is played together with its ability to produce a wide range of notes at the same time. For this reason, the harp has survived as a popular instrument to the twentieth century. This popularity has continued after introduction of the harpsichord which allowed a more mechanistic approach to operation of the harp and even of the piano-forte which only served to partially restore the responsiveness of the harp to the player.

Nevertheless, the harp has not made the transition to popular twentieth century music. This has occurred because of a number of understandable problems. First of all, the harp is a relatively heavy and cumbersome device not easily transportable by a band or other musical group. In its simplest form, it is a diatonic instrument and addition of the mechanical systems for making the harp a chromatic instrument poses other problems. In addition, a chromatic instrument becomes somewhat more delicate and liable to breakage, and, accordingly, even harder to move from one place to another. In addition, operation of the instrument is also complicated by the addition of pedals or other mechanisms necessary to achieve chromatic operation.

In order to make the transition into, for example, rock and roll music, the harp also suffers from the problems of being a mechanical instrument. Pick-up via a microphone is clumsy due to the large distance over which strings are disposed. Likewise, spurious vibrations, harmonics and the like are a serious problem with conventional vibrating string pick-ups, such as those in an electric guitar. These problems would be further worsened by the use of a conventional chromatic arrangement, slightly improper actuation of which would, for practical purposes, disable the instrument.

Some attempt has been made at solving these problems by the implementation of harp voices in electronic organs. While this has had the effect of introducing harp-like sounds into popular music, such instruments fall far short of the responsiveness of a conventional harp to the player.

DISCLOSURE OF INVENTION

The invention, as claimed, is intended to provide a remedy. It solves the problem of how to make an electric harp, which is lightweight, portable, mechanically sound and reliable and is capable of a chromatic electrical output substantially free of parisitic, harmonic, and spurious responses.

In accordance with the present invention, the above is achieved through the use of conventional strings which drive pitch altering subsystems. The subsystem may use electronic multipliers or other means which result in an output which is a function of inputs from the string. In this manner, the player is given direct control of the output, with that control being exercised manually at the string in the manner of a conventional harp.

BRIEF DESCRIPTION OF DRAWINGS

One way of carrying out the invention is described in detail below with reference to the drawing which illustrates only one specific embodiment, in which.

BEST MODE FOR CARRYING OUT THE INVENTION

Figure 1:
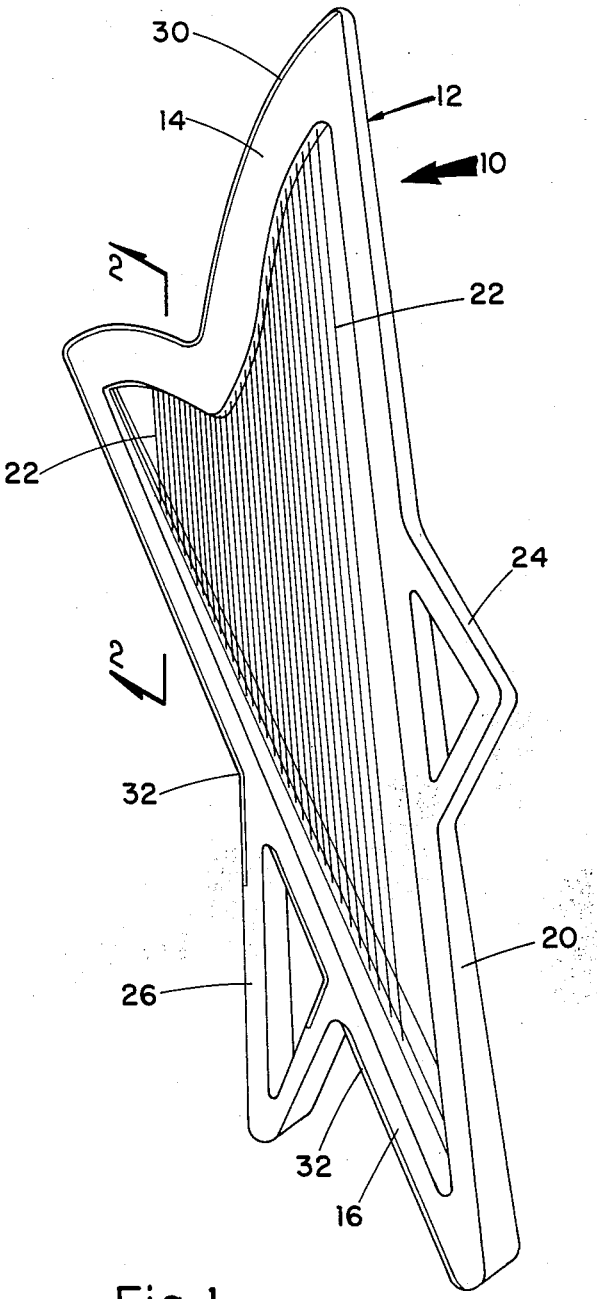
FIG. 1 is a perspective view of an electric harp constructed in accordance with the present invention.

Referring to FIG. 1, the inventive harp 10 comprises a frame 12 which in turn comprises an upper tensioning member 14 and a lower tensioning member 16. Rigidity of the structure is provided by arm 20 which serves to maintain the separation between opposite ends of members 14 and 16. The acoustical portion of the harp includes a plurality of strings 22. Finally, vibration damping is provided by handle 24 and foot 26 which, in addition to their functions of deadening spurious vibrations also act to provide a convenient support for the harp (foot 26) and means for holding the harp (handle 24).

Figure 2:
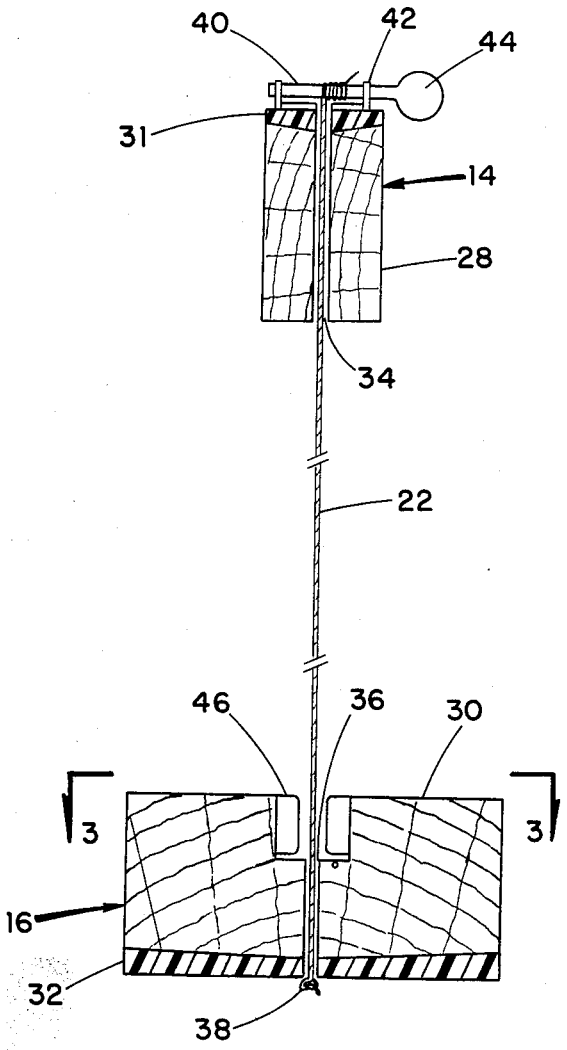
FIG. 2 is a view along lines 2—2 of FIG. 1 illustrating a portion of the harp in cross section.

It is noted that all of the elements of the frame 12, including, the upper tensioning member 14, the lower tensioning member 16, arm 20, handle 24, and foot 26 are all made of solid material and include no soundbox as in a conventional harp. Foot 26 allows the inventive harp to be self-supporting and allows easy positioned adjustment to the comfort of the player. This is seen somewhat more clearly in FIG. 2 where the upper member 14 and lower member 16 are seen to include rigid members 28 and 30, respectively. Sound damping may be provided by a layer 31 of plastic, rubber or rubber-like material provided on upper member 14 and a similar layer 32 may be provided on lower member 16. Strings 22 are held in tension and extend through holes 34 and 36 in upper member 14 and lower member 16, respectively. The strings are held in place by a knot 38 at one end of the string and a spindle 40 at the other end of the string. The other end of the string is wrapped around spindle 40 which, in turn, is held in a bracket 42 of conventional design which allows varying tension of the string by adjustment of knob 44.

Figure 3:
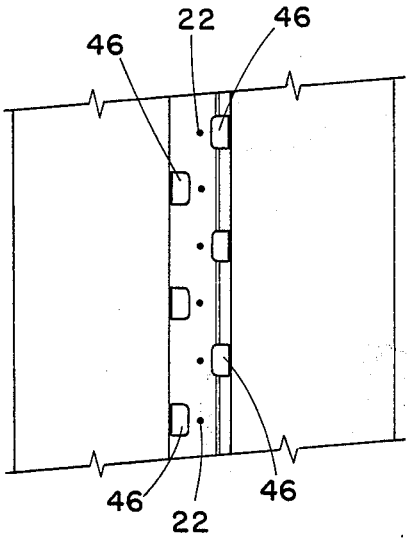
FIG. 3 is a view along lines 3—3 of FIG. 2 illustrating the transducer arrangement of the inventive harp.
Figure 4:
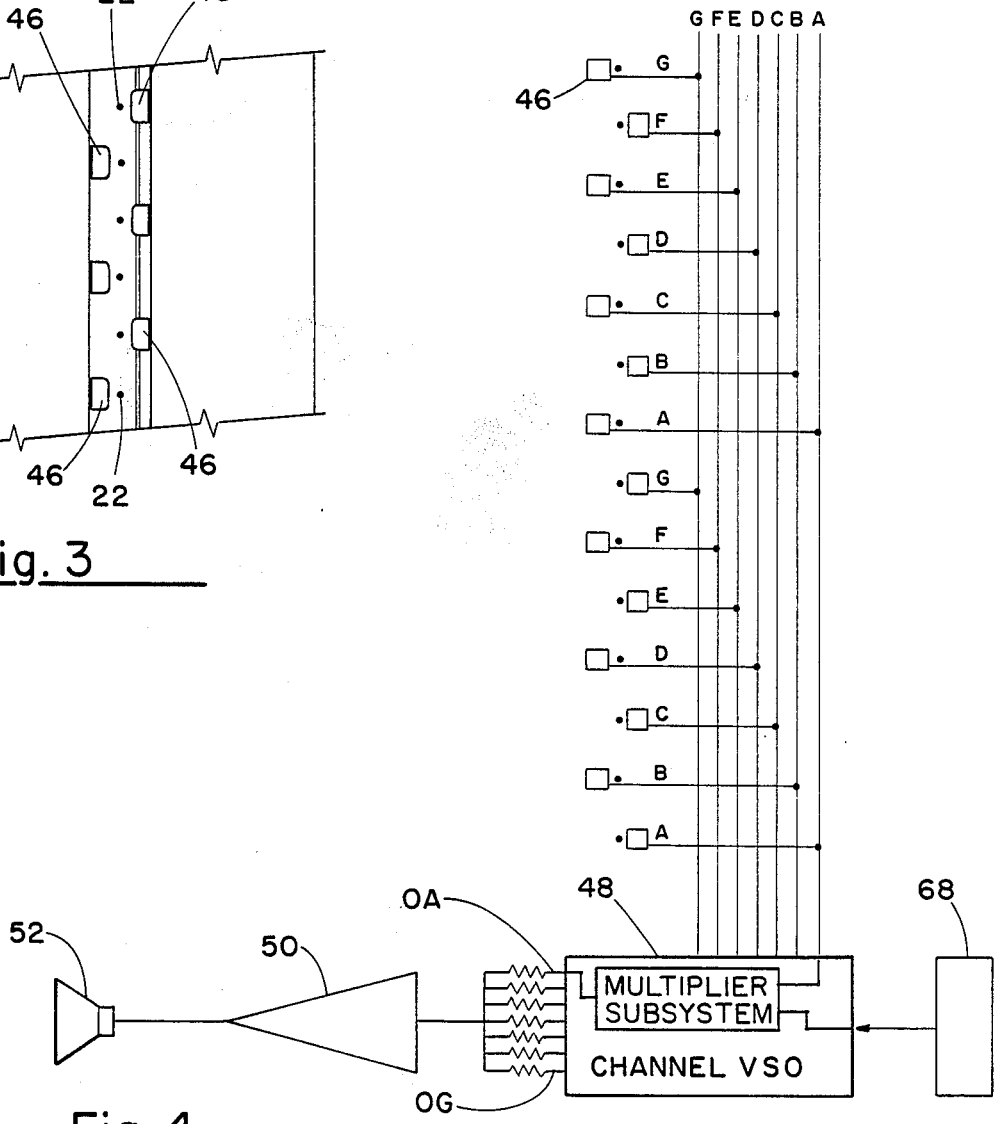
FIG. 4 is a schematic diagram of the electronic portion of the inventive harp.

Vibration of the string is detected by a plurality of pick-ups 46 disposed at opposite ends of the arrangement of strings 22 as ilustrated in FIG. 3. These pick-ups are of conventional design and detect vibrations of their respective string 22. The electrical output of pick-ups 46 are in turn provided to seven input bus lines A–G as illustrated in FIG. 4. Each of the input bus lines correspond to a note on a diatonic scale and harmonics thereof. Thus all the pick-ups associated with the note G are connected to input bus line G. Channel VSO 48 comprises seven subsystems such as that of FIG. 5 and is an electrical device having the characteristic of inputting through its output, a note which is either a sharp version, a flat version, or the natural of the note input from its respective input bus line. Thus, if input bus line B receives B below middle C, its respective output line OB will input either B-flat, B, or C, depending upon whether channel VSO 48 has been instructed to deliver a flat, natural, or sharp note, respectively. Output lines OA–OG are then connected to resistors A–G which act as a summing device to the input of amplifier 50. The output of amplifier 50 drives a conventional speaker system 52 or the speaker system and amplifiers associated with a given band.

Figure 5:
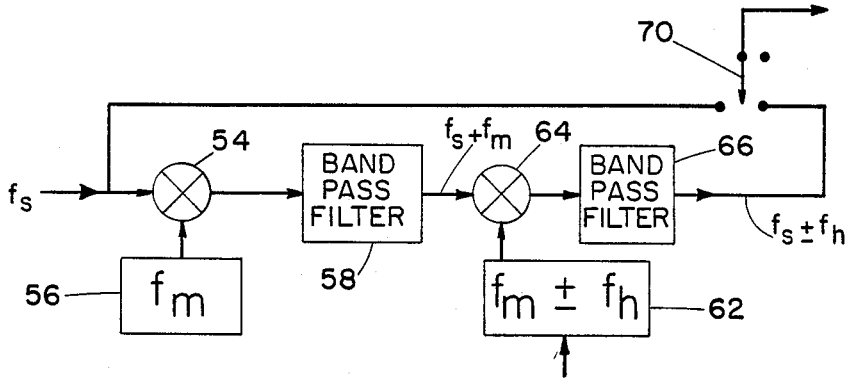
FIG. 5 is a detailed schematic of one of seven multiplier subsystems which form the channel VSO.

A respective multiplier subsystem is driven by all strings representing different octaves of the same note for the seven notes of, for example, the key of C. As illustrated in FIG. 5, the electrical output of a string at frequency $f_s$ is applied to a multiplier 54 which acts as a mixer. A mixing signal $f_m$ is also applied to multipler 54 by a local osciallator 56. Signal $f_m$ acts as a hetrodyne input. One of the resulting products of the mixing operation is a signal with frequency $f_s+f_m$. This frequency is selected by a band pass filter 58 which has the electrical characteristic of passing signals around the frequency $f_s+f_m$ and harmonics thereof. Thus, in the event that the B string is plucked and $f_s$ corresponds to the frequency or pitch of the note B below middle C, band pass filter 58 will pass a signal having a frequency equal to the frequency of B plus the hetrodyne of frequency. This signal will, in turn, be mixed with the output of a second local oscillator 62 which is mixed with the output of band pass filter 58 by multiplier 64. Local oscillator 62 produces a frequency equal to $f_m \pm f_h$, where $f_h$ is equal to the pitch variation for making a note either sharp of flat.

Accordingly, mixer 64 passes the input frequency of the string minus the hetrodyne frequency $f_m \pm f_h$. This effectively results in producing both sharps and flats of input signals. The output of multiplier 64 will, in turn, be passed to a band pass filter 66 which passes frequencies centered on the original note, in the example B below middle C, and harmonics thereof and is broad enough to accommodate a half note variation either up or down in pitch. Accordingly, the output of band pass filter 66 has the frequency or pitch $f_s \pm f_h$. Each of the primary notes A–G and its respective input line A–G drives a multiplier subsystem such as that illustrated in FIG. 5. Likewise, the respective subsystem drives its respective output line OA–OG. Selection of the sharp, flat or natural note for each subsystem is done by control circuit 68 which controls oscillator 62 and switch 70.

While an illustrative embodiment of the invention has been described, it is, of course, understood that various modifications of the invention will be obvious to those of ordinary skill in the art. Such modifications are within the spirit and scope of the invention which is limited and defined only by the appended claims.

I claim:

1. An electric harp, comprising:

(a) a first tensioning member having a plurality of holes disposed along its length;

(b) a second tensioning member secured to said first tensioning member at first ends of said first and second tensioning members, said second tensioning member having a plurality of holes disposed along its length;

(c) a string passing through one hole on said first tensioning member and its corresponding hole on said second tensioning member;

(d) stop means for securing said string in said first tensioning member;

(e) adjustable securing means for adjustably securing said string to said second tensioning member;

(f) support means for maintaining said first tensioning member rigidly fixed with respect to said second tensioning member, said first and second tensioning members and said support means forming a frame;

(g) vibration damping means for damping vibrations in the frame;

(h) pick-up means for detecting vibration of said string; and (i) frequency selection means responsive to said pick-up means to produce a signal having a frequency which is a function of the resonant frequency of said string.

2. An electric harp as in claim 1, wherein said vibration damping means is the solid internal cross-section of said first tensioning member.

3. An electric harp as in claim 1, wherein said vibration damping means is a resilient rubber-like member against which said stop means bears and against which said adjustable securing means bears.

4. An electric harp as in claim 1, wherein said vibration damping means comprises a foot which is secured to said first tensioning member.

5. An electric harp as in claim 4, wherein said support member is an arm and further comprising a handle secured to said support member.

6. An electric harp as in claim 1, wherein said frequency selection means comprises means for varying the pitch of an input signal either higher or lower in frequency.

7. An electric harp as in claim 6, wherein said frequency selection means comprises a first heterodyne circuit for raising the frequency of the signal output by said pick-up and a second heterodyne circuit for lowering the frequency of the signal output by said pick-up.

8. An electric harp as in claim 1, wherein said first and second tensioning members are made of oak.

* * * * *